US006695250B2

(12) United States Patent
Michalik et al.

(10) Patent No.: US 6,695,250 B2
(45) Date of Patent: Feb. 24, 2004

(54) DEVICE FOR DEFLECTING A MATERIAL WEB

(75) Inventors: Horst Bernhard Michalik, Höchberg (DE); Manfred Wolfgang Hartmann, Elfershausen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/221,189

(22) PCT Filed: Mar. 16, 2001

(86) PCT No.: PCT/DE01/01016

§ 371 (c)(1),
(2), (4) Date: Sep. 23, 2002

(87) PCT Pub. No.: WO01/70609

PCT Pub. Date: Sep. 27, 2001

(65) Prior Publication Data

US 2003/0047644 A1 Mar. 13, 2003

(30) Foreign Application Priority Data

Mar. 22, 2000 (DE) ..... 100 14 257
May 11, 2000 (DE) ..... 100 22 964

(51) Int. Cl.[7] ..... B65H 23/32
(52) U.S. Cl. ..... 242/615.21
(58) Field of Search ..... 242/615.21

(56) References Cited

U.S. PATENT DOCUMENTS

| | | | | |
|---|---|---|---|---|
| 2,136,278 A | * | 11/1938 | Dean | 242/615.21 |
| 2,760,773 A | * | 8/1956 | Brodie | 242/615.21 |
| 3,206,089 A | * | 9/1965 | Huck | 242/615.21 |
| 3,434,639 A | | 3/1969 | Cowles | |
| 3,734,487 A | | 5/1973 | Treff | |
| 3,809,303 A | | 5/1974 | Brunner | |
| 4,863,087 A | * | 9/1989 | Kohler | 242/615.21 |
| 5,100,117 A | | 3/1992 | Hajek et al. | |
| 5,108,022 A | | 4/1992 | Birkmair et al. | |
| 5,273,201 A | | 12/1993 | Hambrecht | |
| 5,520,317 A | * | 5/1996 | Eckert | 242/615.21 |
| 5,568,245 A | | 10/1996 | Ferber et al. | |
| 6,047,922 A | | 4/2000 | Michalik | |

FOREIGN PATENT DOCUMENTS

| | | |
|---|---|---|
| DE | 2 020 139 | 11/1970 |
| DE | 1 761 899 | 12/1971 |
| DE | 87 17 253.4 | 8/1988 |
| DE | 38 16900 C1 | 11/1989 |
| DE | 41 17 094 A1 | 12/1992 |
| DE | 196 40 978 A1 | 11/1997 |
| EP | 0 342 491 A2 | 11/1989 |
| EP | 0 697 634 A1 | 2/1996 |
| EP | 0 784 590 B1 | 4/1999 |
| EP | 1 024 101 A1 | 8/2000 |
| GB | 1264947 | 2/1972 |
| WO | WO 97/40985 | 11/1997 |

* cited by examiner

*Primary Examiner*—John M. Jillions
(74) *Attorney, Agent, or Firm*—Jones, Tullar & Cooper, PC

(57) ABSTRACT

Paper web sections which may have been produced by longitudinally cutting a wide paper web, and which are being fed in a production direction, are laterally shifted with respect to that production direction. The web sections are fed within a device for deflecting the paper webs transversely from the left and from the right, with respect to the machine production direction. Two upper 45° deflection devices are supported by lateral side frames and can be displaced horizontally transversely to the machine production direction. Each of these two upper deflection devices has a lower surface that lies in a horizontal plane and the two horizontal planes have different heights.

13 Claims, 7 Drawing Sheets

DEVICE FOR DEFLECTING A MATERIAL WEB

FIELD OF THE INVENTION

The present invention is directed to a device for deflecting a web of material. At least two turning bars are displaceably arranged in a common guide.

BACKGROUND OF THE INVENTION

A device for shifting narrow paper webs in the form of partial paper webs is known from DE 38 16 900 A1.

DE-AS 17 61 899 shows turning bars which are staggered in height.

U.S. Pat. No. 3,734,487 discloses two turning bars arranged in a triangle. A web of material can be conducted to a registration roller from these turning bars.

EP 0 784 590 B1 discloses a turning arrangement in which a guide roller and the turning bars have different diameters. The turning bars, which are arranged at 90° in respect each other are of equal diameter.

SUMMARY OF THE INVENTION

The object of the present invention is directed to providing a device for deflecting a web of material.

In accordance with the present invention, this object is attained by supporting at least two turning bars for displacement in a common guide. The turning bars and any registration rollers, which may also be included in the web deflecting device, are arranged to minimize the height of the device. The turning bars are typically arranged at approximately 45° to the production direction of the web or webs entering the device.

The advantages which can be achieved by the present invention reside primarily in that a guidance arrangement can be created which, when viewed in the running direction of the paper web, permits a shorter construction than prior guidance arrangements, and with at least the same number of partial paper web shifts, and which can serve downstream-connected devices with several longitudinal folding devices and/or transverse cutting devices. It is moreover possible to achieve a lower structural height.

The number of deflection devices can be reduced. Shorter paper travel is also achieved. The linear register or cutting register remains within the permissible tolerance range during braking, and of course also acceleration of the web, even at the highest web running speeds, so that the amount of waste is clearly reduced. This register maintenance is the result of the fact that the linear registration rollers are only laid out to the maximum width of the partial paper webs, and not to the maximally possible paper web width. Because of this, the centrifugal masses of the rollers, which must be accelerated or braked, become considerably smaller. It is possible to bring the turning bars in each horizontal plane, which number can be one, two or even more, individually or together to preselectable positions by use of a remotely controllable drive mechanism, which substantially shortens the required amount of time for production changes. Each one of these web deflecting or guidance arrangements can be produced as a whole, with all electro-pneumatic and mechanical installations, as a stackable modular unit by itself. Depending on the number of paper webs, or partial paper webs, to be processed, the modular units are then stacked on top of each other and are connected with each other to form a paper guidance arrangement.

BRIEF DESCRIPTION OF THE DRAWINGS

A preferred embodiment of the present invention is represented in the drawings and will be explained in greater detail in what follows.

Shown are in.

DESCRIPTION OF THE INVENTION

Figure 5:
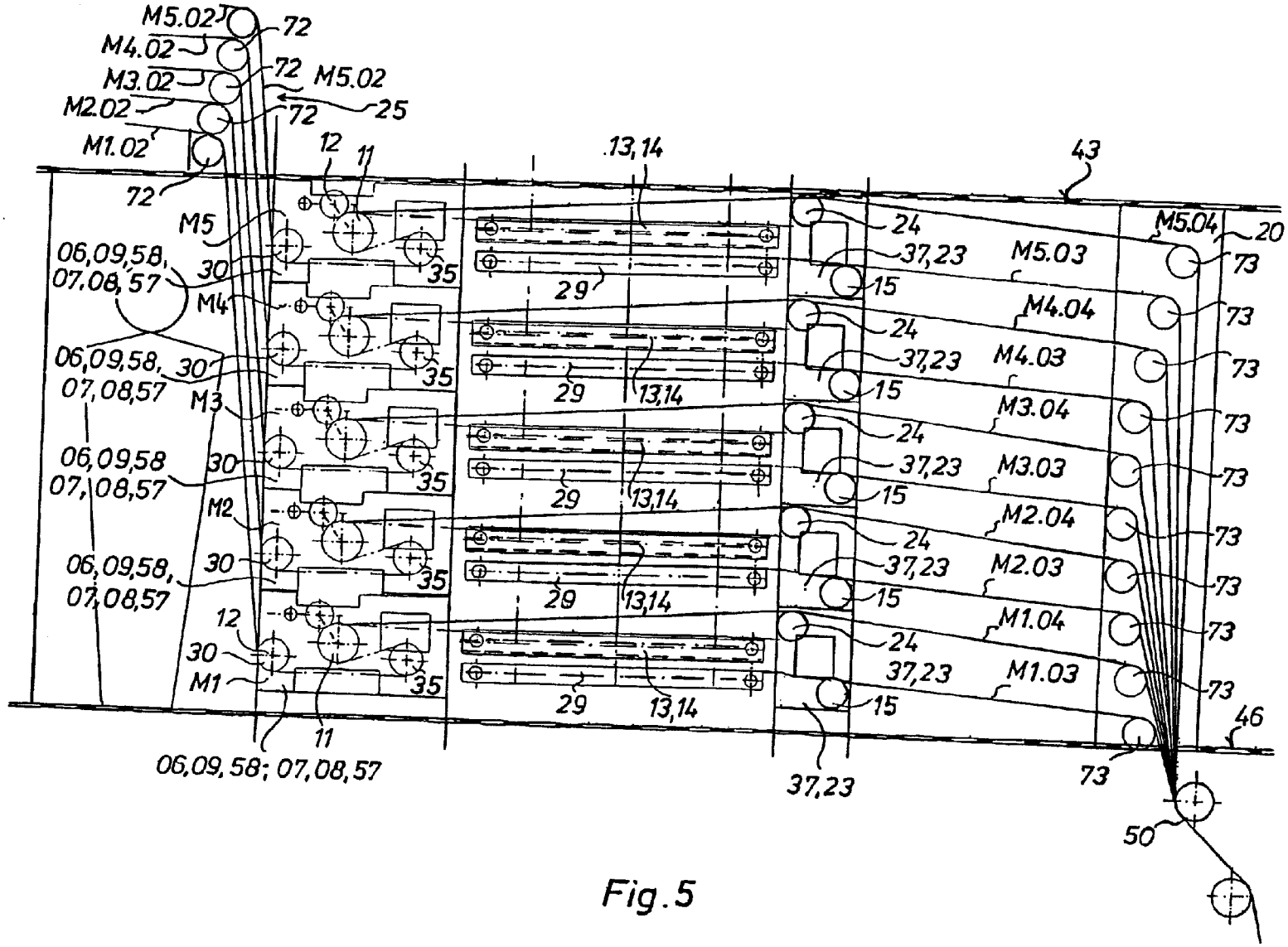

In principle, a left partial paper web entry and a right partial paper web entry into a folding apparatus 50, with at least two upstream-connected longitudinal folding devices, is possible. In actual use, a decision is made prior to planning the layout of a web-fed rotary printing press whether it is to be equipped with a left partial paper web entry or with a right partial paper web entry. With a left entry, a left partial paper web 04 runs, viewed in the paper running direction L, directly, i.e. not turned, into a left longitudinal folding apparatus, for example. With a right entry, a right partial paper web 03 runs, viewed in the paper running direction L, or production direction, directly, i.e. not turned, either directly or via a guide roller 73 of a roller housing frame 20 into a folding apparatus 50 with one or several longitudinal folding devices, as seen in FIG. 5. It is also possible to provide more than two longitudinal folding devices. In this case, the running direction L is the running direction in which one paper web 02, or in which partial paper webs 03, 04, run up on a guide roller 11 in the production direction. Left transverse running directions QL and right transverse running directions QR, as seen in FIGS. 1–3, are web or partial web running directions which refer to the running direction L and are directed transversely to the left (QL), or transversely to the right (QR).

Partial paper webs 03, 04 within the meaning of this application are understood to be not only narrow paper webs 03, 04, 03L, 03R, 04L, 04R, which can be produced by longitudinal cutting from a whole-width or half-width paper web 02. They can also be narrow paper webs 03, 04, which are fed from narrow, so-called quarter-width or eighth-width paper rolls, or also narrow paper webs 03, 04, which originate from other printing presses which are upstream-connected simultaneously with the running production of this paper web guidance device 01, or which are supplied, already preprinted, as a web from a storage device.

Figure 1:
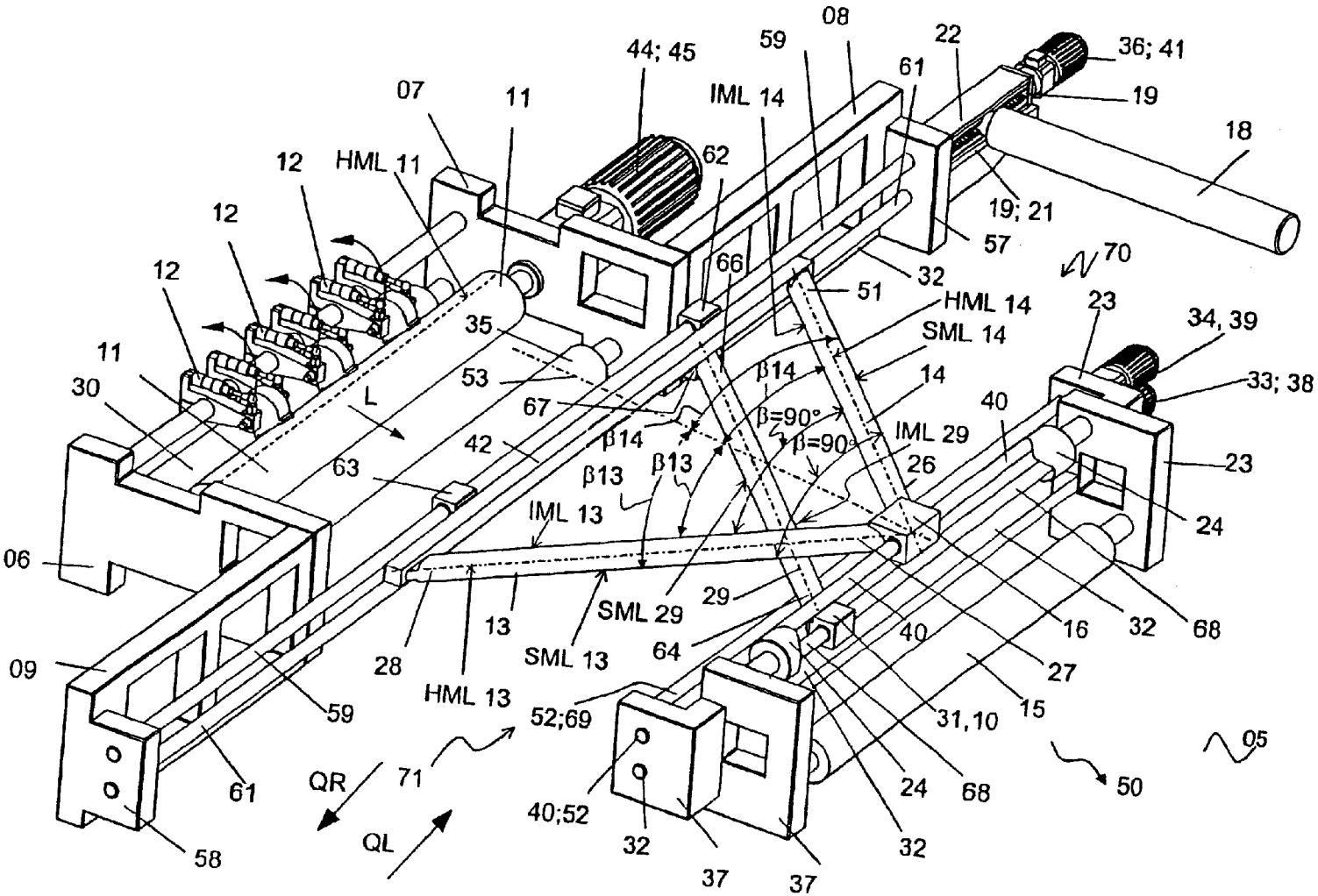
FIG. 1, a material web deflection device module in accordance with the present invention, with a plurality of deflection rollers and deflection arrangements and a linear registration device in a perspective representation, FIG. 2, a material web deflection device module in accordance with FIG. 1 with two partial paper paths of two partial paper webs, with a partial paper web entering from the left, in a perspective representation, FIG. 3, a material web deflection device module in accordance with FIG. 1, with two partial paper paths of two partial paper webs with a partial paper web entering from the right, in a perspective representation, FIG. 4, a side elevation view of the material web deflection device module in accordance with FIG. 1, FIG. 5, a roller housing frame, consisting of a plurality of material web deflection device modules stacked on top of each other, FIG. 6, a partial side elevation of FIG. 1, showing a first type of configuration of a pair of deflection devices, represented in a schematic view opposite the running direction L and with the depiction of the various horizontal planes, FIG. 7, a view similar to FIG. 6 and showing a second type of configuration of a pair of deflection devices, represented in a schematic view opposite the running direction L and with the depiction of the various horizontal planes, and in FIG. 8, a material web deflection device module in accordance with FIG. 1, represented with two paper paths of two partial paper webs, with half a partial paper web of whole web width entering from the left, and with half a partial paper web of whole web width entering from the right, which right entering half web has been cut into two partial paper webs of one-quarter web width, in a perspective representation.
Figure 2:
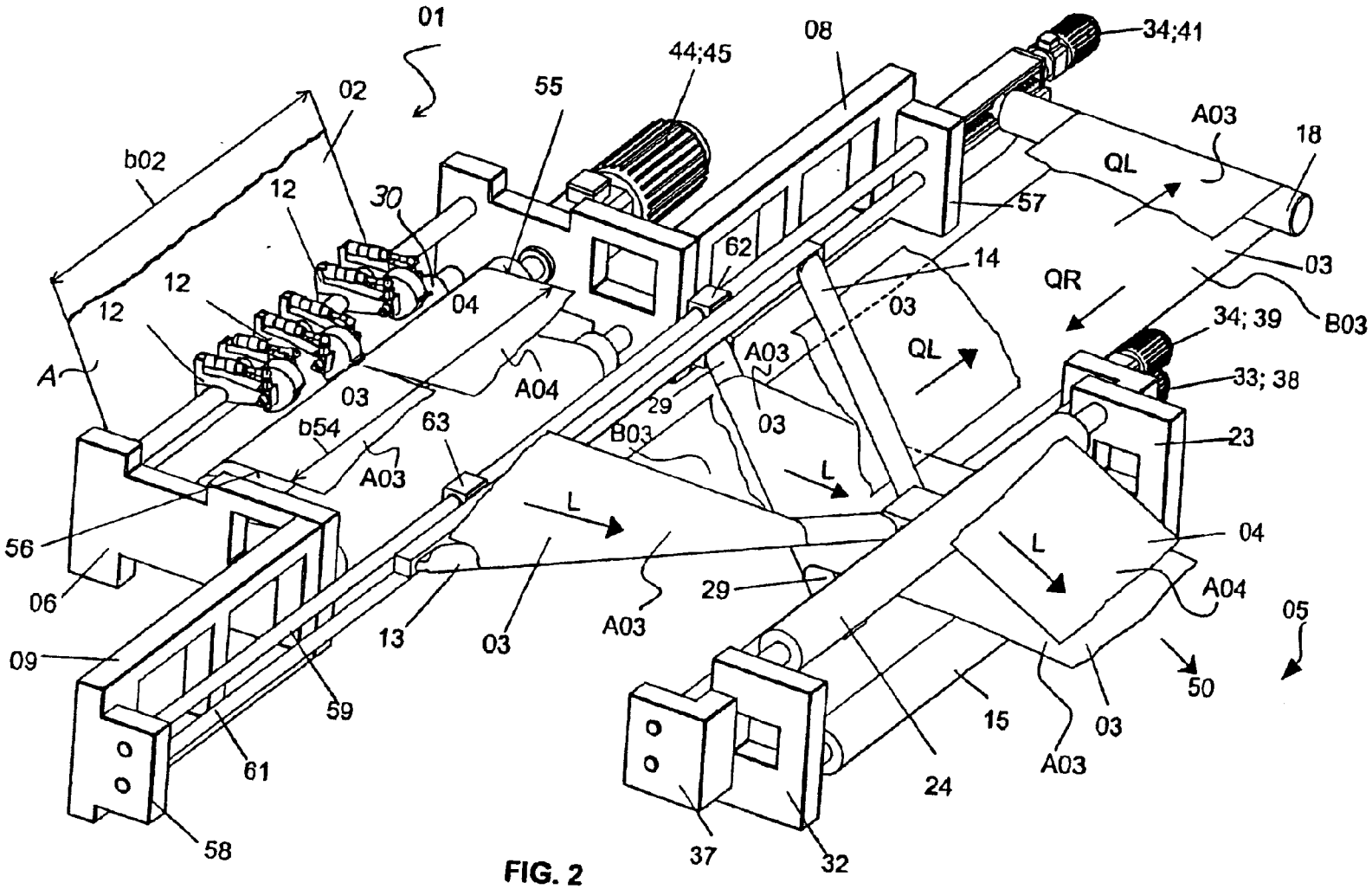
Figure 3:
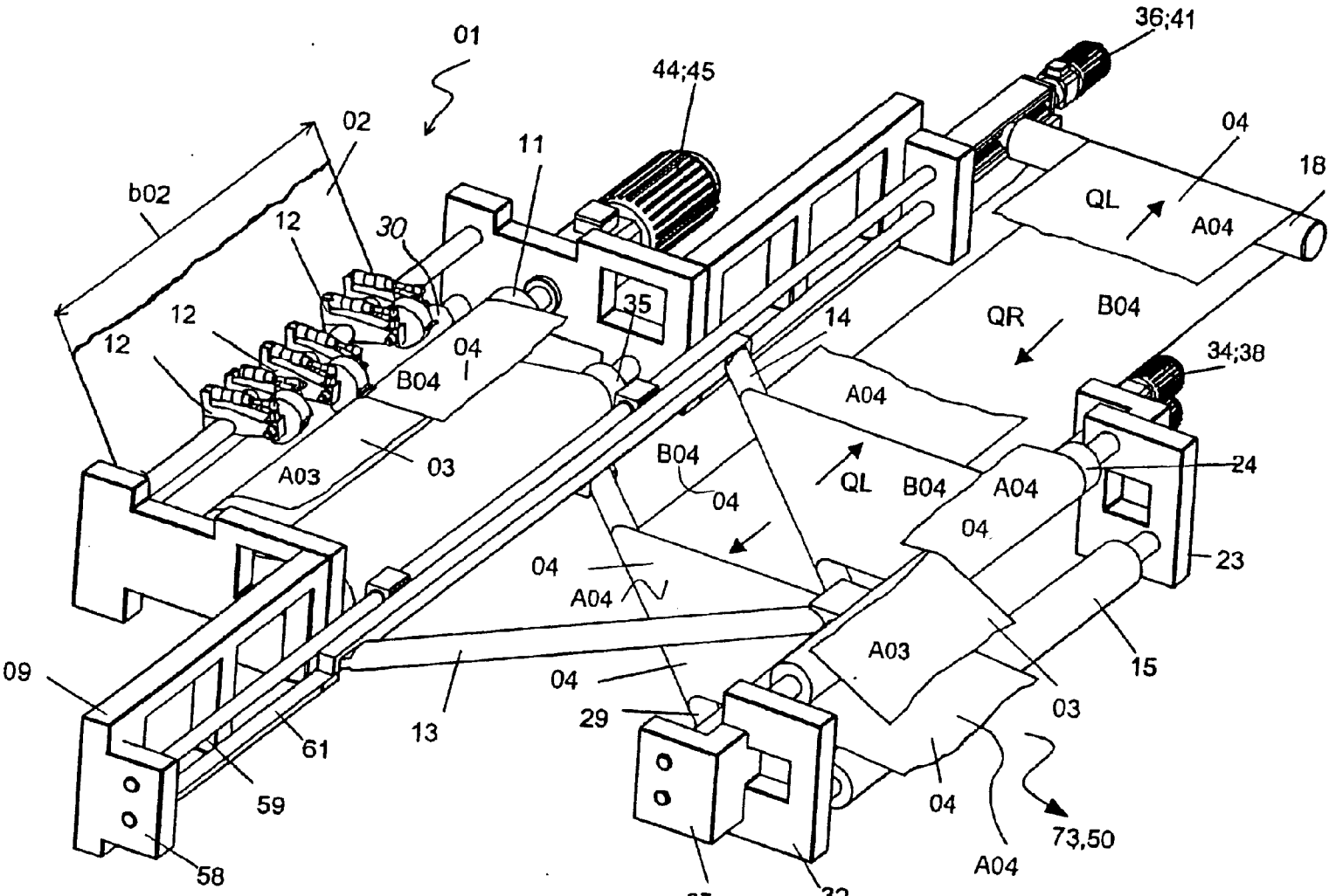

For example, as represented in FIGS. 1, 2 and 3, and as viewed in the paper running direction L, the rollers 30, 11, 35 are rotatably seated in a right lateral frame 06 and a left lateral frame 07 of the paper web guidance or deflection device 01. Both lateral frames 06, 07 are arranged parallel next to each other and are spaced apart.

A left transverse frame 08, or a right transverse frame 09 are attached at right angles to and are supported on the lateral frames 06, 07. They are aligned with each other and they laterally extend past the left lateral frame 07, or the right lateral frame 08, as seen in FIG. 1, for a sufficient length so that—viewed in the transverse running direction QL and QR—there are sufficiently wide movement possibilities to the left and right for web deflection devices, or turning bars 13, 14 . The ends of the transverse frames 08, 09 terminate in a left bearing block 57, or in a right bearing block 58, respectively and they are parallel in respect to each other. The bearing blocks 57, 58 are of the same height and width as the transverse frames 08, 09 and project in the web running direction L. An upper guide rod 59 and a lower guide rod 61 are each attached with their two ends, fixed against relative rotation, in the bearing blocks 57, 58. The guide rods 59, 61 are arranged horizontally and vertically above each other and are spaced at at a minimum possible distance b from each other, for example 8 to 25 cm, depending on the diameters of the deflection devices 13, 14, 29, arranged on top of each other, and the laterally arranged registration roller 18, and at the required horizontal distance from each other.

A paper web 02, for example without being longitudinally cut—because it came from below—coming from a print unit, not represented, which is part of the paper web guidance device 01, or from a print unit which produces in a parallel operation, of another web-fed rotary printing press, or from a preprinted rolled up paper roll, directly reaches a first driven or non-driven guide roller or deflection roller 11. Roller 11 is rotatably seated in lateral frames 06, 07. The guide roller 11 can be embodied as a counter-cutting roller, adjacent which one or several driven longitudinal web cutting devices 12 are arranged so they can be placed against guide roller 11 or moved away from it, as seen in FIG. 1. Roller 11 can also be structured as a driven traction roller. For driving the guide roller 11, a drive mechanism 44, for example an electric or pneumatic motor with an integrated angle of rotation transducer 45 for detecting the actual number of revolutions and/or the actual angle of rotation, is flanged on the lateral frame 07, for example. When using the guide roller 11 as a traction roller, the motor 44 and the angle of rotation transducer 45 and a reference variable transducer, not specifically represented, are connected to a control device, which is not depicted, for setting the desired traction force on the paper web 02.

Figure 4:
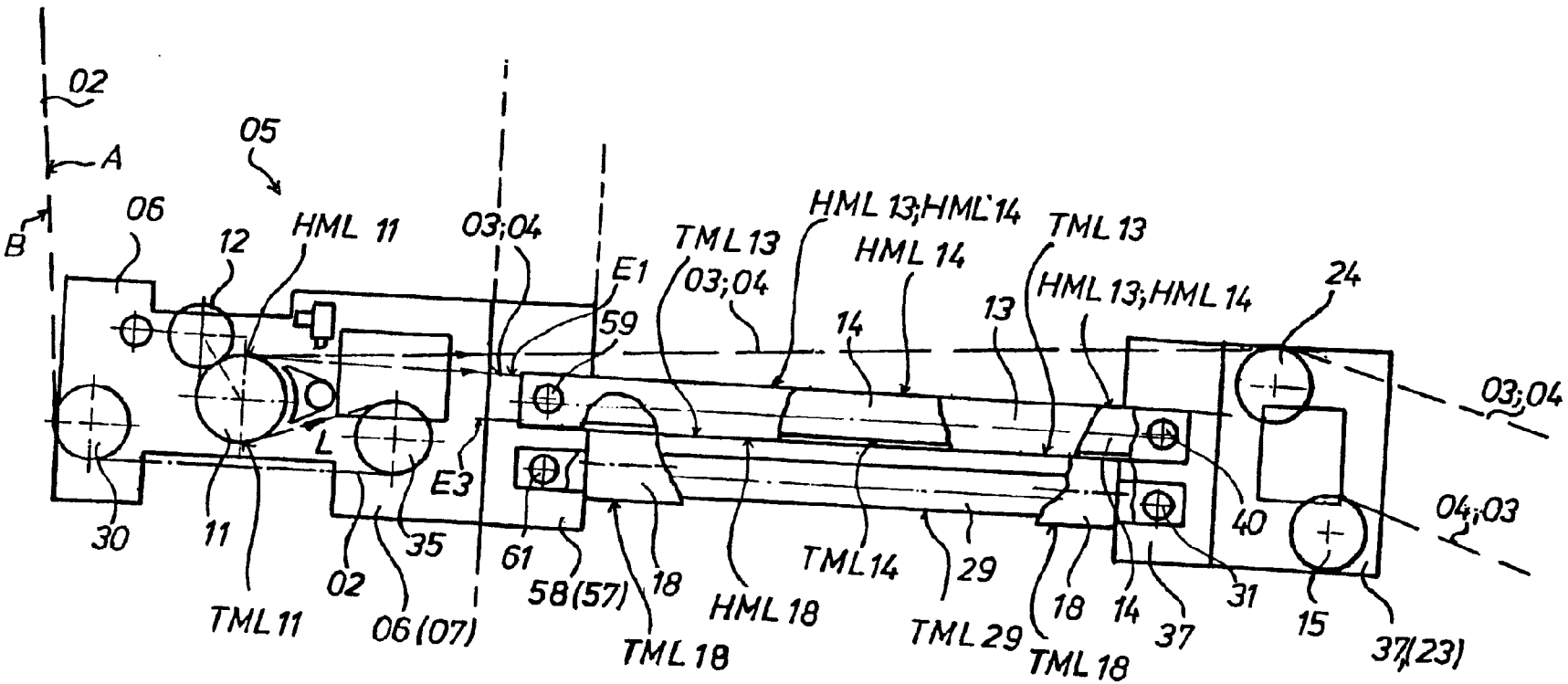

If the paper web 02 enters into the paper web guidance device 01 coming from above, a first additional deflection roller 30 and a second additional deflection roller 35, as seen in FIGS. 4 and 5, are rotatably seated, spaced apart from each other horizontally, in the lateral frames 06, 07. In this case, the axes of rotation of the deflection rollers 30 and 35 lie, viewed in the paper web running direction L, to the left and right of, and at a sufficient distance from the guide roller 11 and on the same horizontal plane. Their axes of rotation preferably lie lower than the axis of rotation of the guide roller 11.

The rollers 30, 35 merely have the object of deflecting the incoming paper web 02, or so-called partial paper webs 03, 04, for example so-called half-width partial paper webs 03, 04, or so-called quarter-width partial paper webs 03L, 03R, 04L, 04R in such a way that they run up correctly on the guide roller 11.

The paper web 02, or the partial paper webs 03, 04 are laterally aligned by utilization of an upstream-located lateral registration device, not specifically represented. The non-longitudinally cut paper web 02, or the several partial paper webs, come to lie within a left web path running border 55 and a right web path running border 56 of a web running path 54, as seen in FIG. 2, whose position in the axial direction of the guide roller 11 can be preset. The web running path 54 has a maximum width b54, which is wider than the maximally permissible paper web width b02, or than the sum of all of the partial paper web widths of the partial paper webs 03, 04, 03L, 03R, 04L, 04R which can enter simultaneously into the paper web guidance device 01, respectively depending on which web width or web width sum is greater.

A registration roller 18, with an associated displacement device 22, is attached to the left bearing block 57 for example by being supported on the outside of the left bearing block 57 of the left transverse frame 08. The device for displacement 22 has a guide device 21 with a movable left carriage 19, on which the registration roller 18 is fastened, for example in a cantilevered manner, i.e. fastened only with one end, on the carriage 19. Its other end is free. The registration roller 18 is respectively displaceable, by movement of the carriage 19, along the partial paper web running direction QL and QR of the partial paper web 03 or 04, partial web which is running up on it, as seen in FIG. 1. For this purpose, the device for displacement 22 has a drive mechanism 36 supported on it, with an integrated angle of rotation transducer 41. The displacement device 22 has, for example, a motor drive 36, 41 with a gear for creating a linear movement. A positionally accurate displacement and fixation in place of the registration roller 18 is possible by operation of this displacement device 22. Such a gear could be, for example, a worm gear with a traction spindle. A similar arrangement is provided on the right side of the paper web guide device but is not specifically shown.

Viewed in the paper running direction L, a horizontal first or right 45° deflection device 13, for example in the form of a right turning bar 13, and to the left of it a horizontal second or left 45° deflection device 14, for example in the form of a left turning bar 14, are provided, with both being spaced apart from the guide roller 11. Their ends 27, 26, remote from the guide roller 11 are rigidly fastened, for example on a common fastening carriage 16 or two separate, separately driveable fastening carriages.

The 45° deflection devices, or turning bars 13, 14 can be displaced and fixed in place, for example by operation of the common fastening carriage 16, transversely to the running direction L into the left transverse running direction QL and the right transverse running direction QR. The deflection devices, or turning bars 13, 14 can be displaced into the left transverse running direction QL and the right transverse running direction QR. The displacement of the right deflection device or turning bar 13 is structured in such a way that its entire length can be displaced along at least the entire width of the provided running path of the whole-width paper web 02 (M1.02, M2.02, M3.02, M4.02, M5.02, etc.) and, further than that, can be moved toward the right completely out of the running path of the whole-width paper web 02, or out of the running path of the right half-width partial paper web 04.

The displacement of the left deflection device, or turning bar 14 is structured in such a way that its entire length can be displaced along at least the entire width of the provided running path of the whole-width paper web 02 (M1.02, M2.02, M3.02, M4.02, M5.02, etc.) and, further than that, can be moved toward the left completely out of the running path of the whole-width paper web 02, or out of the running path of the right half-width partial paper web 04. The movements of the two deflection devices 13, 14 can take place together or individually in the same direction.

The fastening carriage 16 can be displaced interlockingly across a straight upper guide device 52 such as, for example, a dovetail guidance device, which can be a component of a cross arm 69, by use of a motor drive 33 with a gear, and is arranged to be fixed in place. The cross arm 69, and therefore the straight upper guide device 52, extend horizontally between a left short lateral frame 23 and a right short lateral frame 37 and is fastened on the insides of the latter, all as seen in FIG. 1.

A motor drive 34 supported on the transverse frame 08, or on one of the short lateral frames 23 or 37 could be provided as the drive mechanism for the fastening carriage 16. Motor drive 34 can be, for example, an electric servo motor 34 with an angle of rotation transducer 39 flanged to it. The latter is respectively used for determining the actual value of the position of the respective carriage 16, on which one or both of the deflection devices or turning bars 13, 14 are fastened. Furthermore, an electronic control device with an arrangement for presetting a position reference variable, a device for performing the comparison of the reference variable with the actual value, and an actuating device, not represented, for generating a manipulated variable to be fed to the drive 34, are provided for carriage 16. An accurate, and also presettable, positioning of the deflection devices or turning bars 13, 14 is possible.

An exactly positionable linear drive, such as a traction spindle 40, which is interlockingly connected with the carriage 16, for example, or another worm gear, is particularly suited for this.

For supporting the turning bars 13, 14, if they are not to be arranged in a cantilevered manner, their respective ends 28 and 51 close to the guide roller 11 and remote from the carriage 16, can be connected by a cross arm 42. A left guide block 62 and a right guide block 63 are welded to the cross arm 42, each of which guide blocks 62 and 63 has a sliding bore. The guide blocks 62, 63 are threaded on the upper guide rod 59 with a close sliding fit. The two upper deflection devices or turning bars 13,14 can be displaced horizontally in the transverse running directions QR and QL.

The carriage 16 can be slid back and forth between the left short lateral frame 23 and the right short lateral frame 37 in the left and right transverse direction in such a way that the ends 28 and 51 of the upper turning bars 13, 14 near the deflection roller 11 can be displaced as fully as possible over the entire length of the deflection roller 11, or over the path of the maximal paper web width b54.

The turning bars 13,14 can, of course, be air blown in the known manner, at least at the places of their shells around which a partial paper web loops.

The exteriorly located, right extreme lateral generating line, SML13 of the right deflection device or turning bar 13 and the left extreme lateral generating line SML14 of the left deflection device or turning bar 14, or their extensions, form an opening angle $\beta$=90°. The same applies to the farthest innermost lateral generating lines, for example the left inner line IML13 of the deflection device 13 and the right inner line IML14 of the deflection device 14, or their extension of the two deflection devices 13, 14 also preferably form an opening angle $\beta$=90 with the narrowest possible tolerance range. The opening angle $\beta$ is composed of the 45° complementary angle $\beta$13 and the complementary angle $\beta$14.

One of the legs of the complementary angle $\beta$14 lies on the lateral generating line SML14, or IML14, and the other leg on the median line 53 of the opening angle $\beta$.

The opening angle $\beta$(=$\beta$13+$\beta$14) opens opposite the running direction L of the partial paper webs 03, 04 entering into the deflection devices or turning bars 13, 14, i.e. the angle opening $\beta$ points in the direction toward the guide roller 11. Therefore the complementary angle $\beta$13 also opens in the clockwise direction, and the complementary angle $\beta$14 in the counterclockwise direction, each opposite the running direction L.

In this case, the highest generating line HML11 and the extension of the highest generating line HML13 form an angle of 45°, which opens in the direction toward the other deflection device 14.

Figure 7:
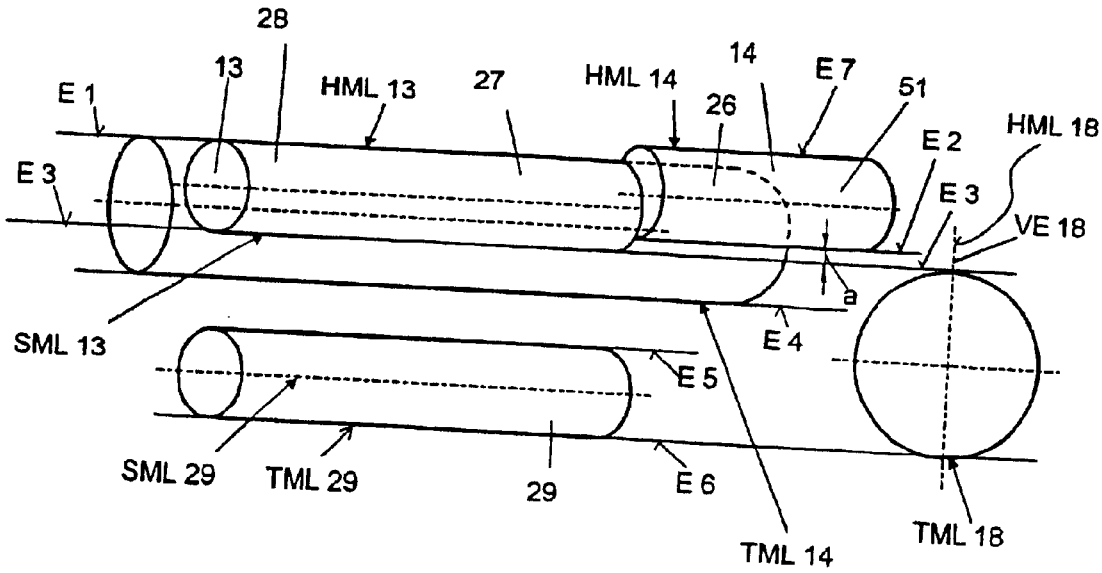
Figure 8:
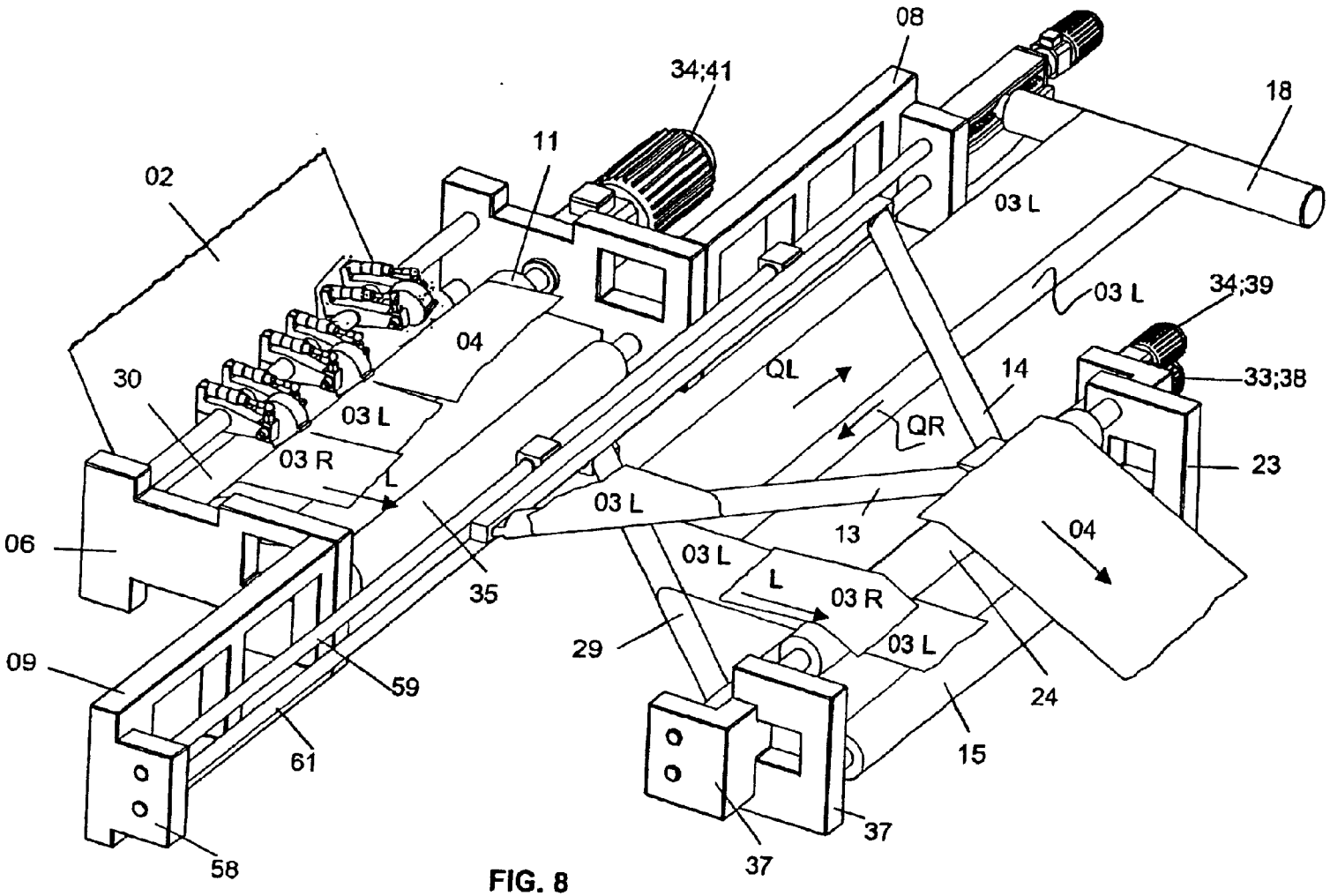

In this case, the highest generating line HML11 and the extension of the highest generating line HML14, as seen in FIG. 7, form an angle of 45°, which opens in the direction toward the other deflection device 13.

Figure 6:
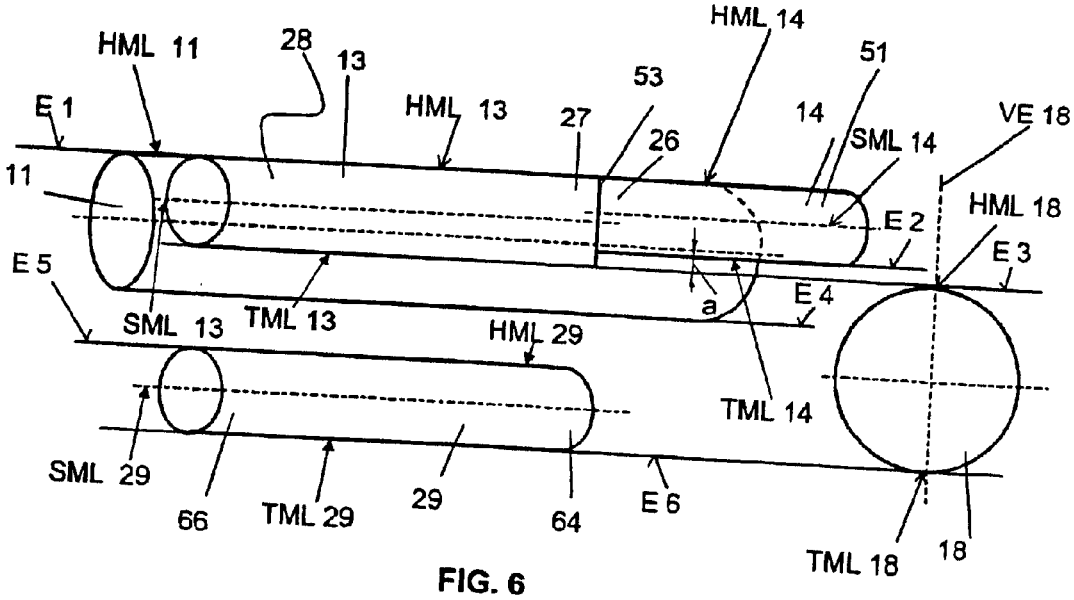

If a paper web crosses below the deflection device or turning bar 14 in the preferred embodiment represented in FIGS. 2, 6 and 7, for example, the lowest generating line TML13 of the deflection device or turning bar 13 must lie in a third horizontal plane E3, as seen in FIG. 6, which lies below the plane E1. The extreme right lateral generating line SML13 of the deflection device 13 lies in a vertical plane VE13 which is not represented.

Both with the left entry and the right entry, the highest generating line HML14 of the left deflection device or turning bar 14, and a highest generating line HML11 of the guide roller 11, and a highest generating line HML 13 of the right deflection device or turning bar 13, can be located on the same horizontal plane, the plane E1 as seen in FIG. 6. This is, for example, achieved in that the largest diameter of the deflection device or turning bar 13 or 14, below which a partial paper web 03, 04 is to cross, is less than the diameter of the other deflection device or turning bar 14 or 13, below which nothing crosses, assuming a circular diameter of the deflection rollers. Because of the different diameters of the deflection devices or turning bars 13, 14, the lowest generating lines TML13 and TML14 of the participating deflection devices or turning bars 13, 14 lie on planes E2 and E3 of different heights, which planes can have a distance "a" from each other which is less than the smallest diameter of the deflection devices or turning bars 14 or 13, for example between 0.8 and 25 mm. The distance "a" mainly depends on the maximum paper thickness and on the type of paper to be printed and is fixed during the construction of the press and is shown in FIGS. 6 and 7.

The lowest generating line TML13 or TML14 of the deflection devices or turning bars 13 and 14 must always be located on a higher plane E2 when it is intended that a partial paper web 03 or 04 is to cross below it on its way to the laterally arranged registration roller.

A third or lower horizontally displaceable deflection device or turning bar 29 is arranged below the two horizontally displaceable upper deflection devices or turning bars 13, 14. Turning bar 29 can be horizontally displaced in the left transverse running direction QL and the right transverse running direction QR, i.e. toward and away from the registration roller 18.

The displacement of the third or lower deflection device or turning bar 29 is structured designed in such a way that turning bar 29 can be displaced over its entire length along at least the entire width of the intended running path of the whole-width paper web 02 (M1.02, M2.02, M3.02, M4.02, M5.02, etc.) and, further than that, respectively in the direction toward the registration roller, in this preferred embodiment, toward the right, so that turning bar 29 can be moved toward the right completely out of the running path of the ]whole-width paper web 02, or out of the running path of the right half-width partial paper web 04.

An end 66 of the third deflection device 29 close to the deflection roller 11, is fastened on a third guide block 67 having a guide bore. The guide block 67 has been displaceably threaded via its bore on the lower guide rod or the lower linear guide 61. No separate drive mechanism is provided for the guide block 67. The other end of the lower turning bar 29, which is the end 64 remote from the deflection roller 11, is rigidly fastened on a second fastening or guide carriage 31.

The guide or fastening carriage 31, with its guide 10, is arranged displaceably and can be fixed in place interlockingly along a straight guide device 32, for example a dovetail guidance device, which can be a component of a cross arm 68, by use of a motor drive 33 with a gear. The cross arm 68, and therefore the straight guide device 32, extends horizontally between the left short lateral frame 23 and the right short lateral frame 37 and is fastened on the insides of the latter.

The electric servo motor 33, with an integrated angle of rotation transducer 38, flanged to the left short lateral frame 23, is provided as the drive mechanism for the carriage 31. Angle of rotation transducer 38 is used for determining the actual value of the position of the carriage 31, on which the lower deflection device or turning bar 29 is fastened. Furthermore, an electronic control device with an arrangement for presetting a position reference variable, a device for performing the comparison of the reference variable with the actual value, and an actuating device for generating a manipulated variable to be fed to the drive 33, are provided. Thus, an accurate, and also presettable, positioning of the lower deflection device or turning bar 29 is possible.

An exactly positionable linear drive, such as a traction spindle 65, which is interlockingly connected with the carriage 31, for example, or another worm gear, is particularly suited for this.

Viewed in the paper web running direction or the production direction L, an extreme right lateral generating line SML29 and/or an extreme inner left generating line IML29 of the deflection device 29, or their extensions, always form an angle β29=45° with the running direction L. This angle β29 opens in the running direction L. This is always the case, regardless in which position in the QL or QR the lower, third deflection device or turning bar 29 might be, if, viewed in the running direction L, the registration roller 18 is provided to the left of the left deflection device or turning bar 14.

A vertical plane VE14, which is not represented, in which the inner generating line IML14 of the left deflection device or turning bar 14 lies, and a vertical plane VE29, which is also not represented, in which the extreme lateral generating line SML29 of the lower or third deflection device or turning bar 29 lies, always extend parallel with each other, as seen in FIGS. 1 to 3, 6, 7, in an arrangement wherein the registration roller 18 is arranged on the left and is parallel with the running direction L.

However if, viewed in the running direction L, the registration roller 18 is arranged to the right of the right deflection device or turning bar 13 which position is not represented in the drawings, a vertical plane VE13, in which the inner generating line IML13 of the right deflection device 13 is located, and a vertical plane VE29, in which the extreme lateral inner or left generating line IML29 of the third deflection device 29 lies, always extend parallel with each other.

Moreover, the extreme lateral or right generating line SML29 and/or the extreme inner generating line IML29, or their extensions, always form an angle β29=45° with the running direction L, which angle β29 opens opposite the running direction L, regardless of the position transversely to the running direction L in which the lower or third deflection device 29 may be. In this case the position of the registration roller 18 in relation to the planes E3 and E4 does not change.

The lower turning bar 29 can be moved back and forth along its assigned cross arm 68 in such a way that its end 64, which is remote from the deflection roller 11, i.e. its end close to the deflection roller 15, can be moved close to the insides of the two short lateral frames 23 and 37. This means that the partial paper web 04, with left entry, as depicted in FIG. 2, or the partial paper web 03, with right entry, as depicted in FIG. 3, which is deflected by the lower deflection device or turning bar 29 in the direction toward the deflection roller 15, can be placed as desired, i.e. continuously in the axial direction of the deflection roller 15. The deflection roller 15 has a minimum length which corresponds to the total width of the side-by-side arranged plurality, for example three, four, etc. of longitudinal folding devices. It follows from this that, depending on the entry selected, the partial paper webs 03 or 04, or 03L, 03R, 04L, 04R, etc. can be fed to any of the longitudinal folding devices preselected from the plurality of longitudinal folding devices of the folding apparatus 50.

With a left entry as seen in FIG. 2, a left partial paper web 04 runs, viewed in the web running direction L directly, and without deflection into a transverse running direction QL, QR, from the guide roller 11 directly over the deflection roller 24 (with or without touching it) to a deflection roller, such as a longitudinal folding device entry roller. The later guides the left partial paper web 04 in such a way that it enters the extreme left—of several, for example three—longitudinal folding devices of the folding apparatus 50, which are not specifically represented.

The right partial paper web 03 runs up on the top on the highest generating line HML13 of the obliquely-placed right or upper deflection device or turning bar 13, loops around it, and undergoes a change of its running direction in the process from the running direction L into a transverse running direction QL, extending transversely to the former, in the direction toward the registration roller 18 arranged on the left. On its way to the registration roller 18, the transversely deflected right partial paper web 03 thereafter crosses below the left deflection device or turning bar 14 at the distance "a" within the space between the higher plane E2, in which the lowest generating line TML14 of the deflection device 14, and the lower located plane E3, in which the lowest generating line TML13 of the right deflection device 14 are enclosed. Finally, on the highest generating line HML18 in the plane E3 it runs up on the registration roller 18, arranged on the left, and loops around it. It leaves the registration roller 18 at the lowest generating line TML18 in the plane E6 of the registration roller 18 and moves in the transverse running direction QR; i.e. the direction extending transversely to the right of the running direction L, to the lower deflection device 29 that is placed obliquely at 45°. The right partial paper web 03 runs up on the lower deflection device or turning bar 29 at the lowest generating line TML29 in the plane E6 and leaves the deflection device 29 at the highest generating line HML29, which is located in the plane E5 located above the plane E6, with the running direction deflected by 45° out of the running direction QR into the running direction L. From the lower or third deflection device or turning bar 29, the partial paper web 03 crosses, without touching, below an upper deflection roller 24, rotatingly seated in the short lateral frames 23, 37, and finally arrives at the lower deflection roller 15, rotatingly seated in the short lateral frames 23, 37. The lower deflection roller 15 can be selectively accessed from the bottom or from the top by the right partial paper web 03, as well as by the left partial paper web 04 in order to feed the partial paper webs 03, 04 over a further deflection roller, not specifically represented, such as a hopper inlet roller, to any arbitrary longitudinal folding device selected, for example, from three devices, of the folding apparatus 50. Responsible for this is the freely selectable working position of the lower or third deflection device or turning bar 29 in relation to a longitudinal folding device or hopper, for example the first hopper arranged on the extreme right. As already described above, the lower or third deflection device or turning bar 29 can be selectably positioned in such a way that every partial paper web 03, 04, which is deflected by it, enters into the longitudinal folding device selected from a plurality, for example three, of folding apparatus.

With right entry as shown in FIG. 3, a right partial paper web 03 runs, viewed in the web running direction L, directly, and without deflection in a transverse running direction QL, QR, from the guide roller 11 via the deflection roller 24, with or without contact with it, to a longitudinal folding inlet roller. The latter deflects the right partial paper web 03, without changing the main running direction L or production direction, in such a way that it enters through the selected right entry always straight ahead into the right outermost longitudinal folding device of the folding apparatus 50 which is located directly opposite the right entry.

The left partial paper web 04, as also shown in FIG. 3, after it has left the highest generating line HML11 of the guide roller 11, moves in the web running direction L; i.e. in the production direction, at a sufficient distance, for example 5 to 20 mm over the greatest height of the upper deflection devices or turning bars 13, 14 and runs up on the top of the upper deflection roller 24, which is rotatably seated in the lateral frames 23, 37, loops around it and leaves it at its lowest generating line TML24 in plane E1 or E7 of the deflection roller 24 in order to finally run up, against the running direction L, on the highest generating line HML14 in plane E1 or plane E7 on the left deflection device or turning bar 14. Then the left partial paper web 04 passes over the extreme inner generating line IML14 of the deflection device or turning bar 14, placed obliquely at 45°, and leaves it from its lowest generating line TML14, in plane E2, in the left running direction QL and runs to the left registration roller 18. The left partial paper web 04 deflected into the left transverse running direction QL then runs up on the registration roller 18 on the highest generating line HML18, in plane E3 of the latter. Then the left partial paper web 04 is deflected by the registration roller 18 and leaves it at its lowest generating line TML18, in plane E6 in the right transverse running direction QR and finally arrives at the third, lower deflection device or turning bar 29 at the lowest generating line TML29, in plane E6, of the latter. The partial paper web 04 loops around the lower deflection device or turning bar 29 while changing its running direction from the running direction QL to the running direction L. It crosses, without, contact below the upper deflection roller 24 and arrives at the deflection roller 15 arranged below the deflection roller 24. The latter deflects the partial paper web 04, depending on whether the longitudinal folding devices are arranged high or low, upward or down, onto the deflection roller, such as the hopper inlet roller of the folding apparatus 50 depending on the position in which the lower deflection device 29 has been positioned transversely to the running direction L. This means that the left partial paper web 04 can selectively enter any of the longitudinal folding devices of the plurality of longitudinal folding devices of the folding apparatus 50; for example, it can also enter below the right paper web 03 into the extreme right longitudinal folding device.

It is also possible that the highest generating lines HML13 and HML14 of the upper deflection devices or turning bars 13, 14 are located on different horizontal planes E1 and E7.

A highest generating line HML14 of the turning bar 14 and a highest generating line HML11 of the guide roller 11 can be located on the same horizontal plane E1, wherein, in this case, the highest generating line HML11 and its extension and the extension of the highest generating line HML14 form an angle of 45° or more, opening toward the left, viewed in the running direction of the paper web, or partial paper webs 03, 04 entering on the guide roller 11. Their lowest generating line TML14 lies in a second horizontal plane E2, located at a distance "a" above the plane E3. As already stated above, the distance "a" can lie between 0.8 and 20 mm. It is achieved, by provision of this short distance "a," that a partial paper web 03, 04, in the preferred embodiment the partial paper web 03 seen in FIG. 2, on its way from the guide roller 11 via a 45° deflection device, for example the right deflection roller or turning bar 13, to a linear registration device, for example a registration roller, for example registration roller 18, can move, saving structural height, below the other turning bar, here the turning bar 14, as closely as possible to it and without contacting it.

The extreme lateral generating line SML14 is located in a vertical plane VE14.

The arrangement wherein the highest generating lines, HML13 and HML14 of the 45° deflection devices or turning bars 13, 14 lie in the same horizontal plane E1, is selected when the deflection device or turning bar 13 or 14, below which a web crosses, is intended to have a lesser diameter than the deflection device or turning bar 14 or 13, below which nothing crosses.

However, the highest generating line HML14, or HML 13 can also lie on a seventh horizontal plane E7, which is located above the first plane E1 of the highest generating line HML11 of the guide roller 11. This position arrangement is selected when the turning bars 13, 14 are to have the same circular cross section or diameter and the above mentioned distance "a" is to be achieved, as seen in FIG. 7.

The vertical plane VE13 intersects the generating line HML11, or its extension, at an angle of 45° open toward the right.

The vertical plane VE14 intersects the generating line HML11, or its extension, at an angle of 45° open toward the left.

The lowest generating line TML13 and the highest generating line HML18 of the registration roller 18 lie in the same horizontal plane, which is the third plane E3.

The lowest generating line TML29 of the individual 45° deflection devices, for example of the lower turning bar 29, and the lowest generating line HML18 of the registration device, for example the registration roller 18, lie in the same horizontal plane, the sixth plane E6.

The highest generating line HML18, and preferably also the lowest generating line TML18 lie in a vertical plane VE18. The extensions of HML14, SML14, IML14, TML14, ILM29, HML29, SML29, TML29 intersect the vertical plane VE18, viewed in a counterclockwise direction, at an angle of 135°; SML13, IML13, HML13 intersect at an angle of 45°. In this case the registration roller 18 is arranged on the left as viewed in the running direction L.

If, viewed in the running direction L, the registration roller 18 is arranged on the right, the extensions of HML13, SML13, IML13, TML13, ILM29, HML29, SML29, TML29 intersect the vertical plane VE18, viewed in a counterclockwise direction at an angle of 45°; SML14, IML14, HML14 intersect at an angle of 135°.

The highest generating line HML29 of the 45° deflection device or lower turning bar 29 is located in the horizontal plane E5, the fifth plane. It lies below the plane E4.

The vertical plane VE29, in which the extreme right lateral generating line SML29 lies, intersects the generating line HML11, or its extension, viewed in the running direction of the paper web, or partial paper webs running up on the guide roller 11 at an angle of 45°, opening toward the left.

Thus, the registration roller 18 can be arranged not only on the side of the left deflection device or turning bar 14, but also on the side of the right deflection device or turning bar 13.

In the deflection modules 05; M1, M2, M3, M4, M5, etc., the left first and the right whole-page frames, lateral frames 06, 09, 58, and the lateral frames 07, 08, 57 are spatially separated and are arranged spaced apart from the short left second lateral frames 23 and right second lateral frames 37 as seen in FIGS. 1, 4.

In all whole-page frames or lateral frames, the devices and units arranged on, in and between them, as represented in FIG. 1, can be preassembled into a deflection module 05. On their upper and lower surfaces, all lateral frames are formed or finished so accurately that several identical whole-page frames or lateral frames, 06, 09, 58, and 07, 08, 57 and 37 and 23, and therefore several deflection modules 05, M1, M2, M3, M4, M5, can be stacked on top of each other and can be releasably connected to each other, for example screwed together, so that a deflection device tower results, such as is represented in FIG. 5, for example.

The whole-width paper web 02 can, for example, also be longitudinally cut into more than two partial paper widths of equal width or of different widths 03, 04, depending on the number of longitudinal cutting devices 12 provided. For example, the whole-width paper web 02 can be longitudinally cut into the halfweb-width partial paper widths 03 and/or 04, or into quarter web-width partial paper webs 03L, 03R and/or 04L, 04R. The partial paper webs are then conducted over upper deflection devices or turning bars 13, 14, around registration roller 18, over lower turning bar 29 and over the rollers 24, 15, 73 to the folding apparatus 50.

From the upper deflection rollers 24 and the lower deflection rollers 15, the partial paper webs 03, 04, 03L, 03R, 04L, 04R, can be conducted to a guide roller 73 specifically assigned to it in a separate roller housing frame 20. The roller housing frame 20 consists of two lateral frames, in which a plurality of guide rollers, arranged on top of each, are rotatably arranged, all as seen in FIG. 5.

The axes of rotation of the guide rollers 73, which are arranged on top of each other, are offset horizontally and vertically in such a way that the individual partial paper webs cannot interfere with each other in the course of their entry into the folding apparatus 50. The partial paper webs can run from above or below on the guide rollers 73, depending on whether the folding apparatus inlet is arranged below or above the lowest module M1.

A roller frame 25 with two lateral frames is arranged laterally to the left and above the topmost module M5. A plurality of guide rollers 72 is rotatably seated, spaced apart from each other and on top of each other, in the lateral frames of the roller frame 25. One guide roller 72 is provided for each entering paper web 02, M1.02, M2.02, M3.02, M4.02, M5.02, etc. The roller frame 25 can be arranged above the topmost module, for example above module M5, on two longitudinal supports on the upper assembly plane 43. In this case, the paper webs run, coming from above, at the bottom onto their respectively assigned deflection roller in the module.

If, coming from below, the incoming paper webs 02, M1.02, M2.02, M3.02, M4.02, M5.02, etc. are to run up from above onto their respectively assigned deflection roller 30 in the respective modules, the roller frame 25 can also be arranged on the lower assembly plane 46.

While a preferred embodiment of a device for deflecting a material web in accordance with the present invention has been set forth fully and completely hereinabove, it will be apparent to one of skill in the art that a number of changes in, for example the specific type of printing press with which the device can be used, the particular structure of the longitudinal folders, and the like can be made without departing from the true spirit and scope of the present invention which is accordingly to be limited only by the following claims.

What is claimed is:

1. A device for deflecting a web of material comprising:

a first turning bar having a first diameter and having a lower surface defining a first plane;

a second turning bar having a second diameter and having a lower surface defining a second plane, said first and second planes being spaced at a distance, said distance being less than a smaller one of said first and second diameters; and a common guide, said first and second turning bars being displaceably arranged in said common guide.

2. The device for deflecting a web in accordance with claim 1 wherein said distance is between 0.8 mm and 25 mm.

3. The device for deflecting a web in accordance with claim 1 wherein said first and second turning bars define an opening angle of 90°.

4. The device for deflecting a web in accordance with claim 1 further including a web guide roller before, in a production direction of a web, said first and second turning bars, and a registration roller, after in the production direction, said first and second turning bars.

5. The device for deflecting a web in accordance with claim 4 further wherein said registration roller has an upper surface defining a third plane, wherein said distance is zero and further wherein said first, second and third planes are at the same level.

6. The device for deflecting a web in accordance with claim 1 further including a third adjustable turning bar, said third adjustable turning bar being located below said first and second turning bars.

7. The device for deflecting a web in accordance with claim 4 further including a third adjustable turning bar, said third adjustable turning bar being located below said first and second turning bars.

8. The device for deflecting a web in accordance with claim 7 wherein said third turning bar has a lower surface defining a fourth plane and further wherein said registration roller has a lower surface defining a fifth plane said fourth and fifth planes being approximately the same.

9. The device for deflecting a web in accordance with claim 4 wherein said turning bars and said registration roller define an opening angle of approximately 45°.

10. The device for deflecting a web in accordance with claim 7 wherein said turning bars and said registration roller define an opening angle of approximately 45°.

11. The device for deflecting a web in accordance with claim 4 wherein said web guide roller and said registration roller form an opening angle of approximately 90°.

12. The device for deflecting a web in accordance with claim 1 further including a motor for displacing said first and second turning bars in said common guide.

13. A device for deflecting a web of material comprising:

a first turning bar having a lower surface defining a first plane;

a second turning bar, each of said first and second turning bars being arranged at approximately 45° to a direction of travel of a web entering said device in a production direction;

a registration roller, having an upper surface defining a second plane and a lower surface defining a third plane and being parallel to the direction of travel of a web entering said device in a production direction, said first plane and said second planes being located at the same level;

a third turning bar having a lower surface defining a fourth plane, said third plane and said fourth plane being located at the same level.

* * * * *